US005962796A

United States Patent [19]

Nakamura et al.

[11] Patent Number: 5,962,796

[45] Date of Patent: Oct. 5, 1999

[54] DISC MUSIC BOX

[75] Inventors: Norihiko Nakamura; Hideyuki Tanaka, both of Saitama, Japan

[73] Assignee: Rhythm Watch Co., Ltd., Tokyo, Japan

[21] Appl. No.: 08/931,290

[22] Filed: Sep. 16, 1997

[30] Foreign Application Priority Data

Dec. 27, 1996 [JP] Japan ..... 8-351386

[51] Int. Cl.[6] ..... G10F 1/06

[52] U.S. Cl. ..... 84/97; 84/94.1; 84/95.1; 84/98

[58] Field of Search ..... 84/94.1, 94.2, 84/95.1, 95.2, 96–99, 127, 129

[56] References Cited

U.S. PATENT DOCUMENTS 3,034,390 5/1962 Nichols ..... 84/1.15

4,466,328 8/1984 Kitamura ..... 84/98

*Primary Examiner*—William M. Shoop, Jr.
*Assistant Examiner*—Marlon T. Fletcher
*Attorney, Agent, or Firm*—Kanesaka & Takeuchi

[57] ABSTRACT

A disc music box for playing a melody comprises a base (21); a music box disc (1) having a plurality of engaging drive parts (3) and a drive hole (4); a plurality of music box petals (27*a*) provided on the base; a plurality of star wheels (26) each guided and revolved by one of the engaging drive parts, a turn plate (23) provided coaxially with the music box disc and having a detecting member (42) thereon; a motor (M) provided on the base; a transmission mechanism (24) disposed between the turn plate and the motor to transmit the drive force of the motor to the turn plate; a drive projection (23*d*) provided on the turn plate for engagement with the drive hole of the music box disc for positioning the music box disc; and a switch (43) provided on the base for engagement with the detecting member of the turn plate when the music box disc makes one rotation.

9 Claims, 5 Drawing Sheets

DISC MUSIC BOX

BACKGROUND OF THE INVENTION

1. Field of the Invention

The invention relates to a disc music box for playing a melody by driving to rotate a music box disc having a plurality of play engaging parts in a predetermined play pattern by a motor, rotating star wheels by the play engaging parts engaged at a predetermined play timing, and plucking music box petals by the star wheels to play the melody.

2. Description of the Related Art

Generally known sounding means used for a time signal of a timepiece or the like is not limited to one which produces an inorganic electronic sound by a sounding circuit and a loud speaker, but also includes one which produces a conventional soft music box's sound by a mechanical music box instrument.

Such a music box instrument generally plays a predetermined music number and comprises sounding prongs in a strip shape with a plurality of sounding parts corresponding to the musical intervals, a barrel which is disposed to oppose the sounding prongs and provided with pins protruded to pluck the sounding parts of the sounding prongs with predetermined playing timing, and a drive unit for rotating the barrel at a predetermined speed.

Specifically, the sounding prongs have a substantially oblong metal plate formed in the shape of comb teeth which have the sounding parts corresponding to the number of musical intervals, and these comb teeth (music box petals) have a predetermined length and thickness to have specific pitches to make allotted music box sounds when the tips of the music box petals are plucked. The barrel is formed in a cylinder longer than at least the sounding prongs, disposed to be rotatable and to face the sounding parts of the sounding prongs, and formed intermittent pins corresponding to a music number and protruded from the outer periphery of the barrel which is opposed to the sounding parts of the sounding prongs. And, the drive unit drives to rotate the barrel in a predetermined direction at a given speed, and the respective pins of the barrel pluck the respective sounding parts of the sounding prongs with predetermined timing to play a music number.

Another music box instrument has been proposed which is provided instead of the barrel with a circular plate-shaped music box disc having the pattern of a predetermined music number, and designed so that the music box disc can be changed to play a desired music number.

This music box disc is a circular plate, its one side is divided into a plurality of tracks corresponding to the music box petals of the music prongs, and the engaging and driving units are formed at a position in a circumferential direction corresponding to the playing timing of musical intervals allotted by the tracks. These engaging and driving parts comprise pins protruded from one side of the music box disc or holes having a predetermined diameter. And, the predetermined parts of the sounding prongs are plucked by these engaging and driving parts to play a music box.

A music box having the music box disc includes a circular plate-shaped music box disc having multiple engaging and driving parts to play music, the music box disc is driven to rotate by a drive mechanism of the music box body. And, the music box body has star wheels for plucking the music box petals of the sounding prongs mounted to be rotatable on a star wheel shaft. And, when the music box disc is rotated by the drive mechanism, the engaging and driving parts of the music box disc engage with picks of the star wheels which correspond to the engaging and driving parts to rotate the star wheels, and the music box petals are plucked by other picks which are subsequent to the rotating star wheels to produce music box sounds to play a melody.

This disc music box holds the music box disc at a position opposed to the star wheels by pushing from one side by a music box disc holding arm which is provided with a holding roller, so that a relatively thin music box disc can be used. Therefore, music box discs having different patterned music numbers formed can be produced in a large number inexpensively, stored and managed easily because they are thin, and transported efficiently.

In addition, since the music box discs are handled with ease, they can be attached to or removed from the music box readily and exchanged in a short time. Therefore, when a plurality of music box discs for different music numbers are provided in advance and a music box disc is changed to another disc for a desired music number, a music number to be played can be changed quickly and with ease.

As described above, the disc music box is easy to mount a desired music box disc by selecting from a plurality of music box discs as compared with the music box provided with a stationary barrel for a single music only. It has an advantage that music numbers can be changed flexibly and easily.

As described above, this music box holds the music box disc positioned to oppose the star wheels by pressing from its one surface by a music box disc holding arm which has a holding roller, so that it is advantageous to use a relatively thin music box disc. On the other hand, a drive roller is disposed on a part of the holding roller of the music box disc holding arm to rotate the music box disc by the music box disc holding arm. Therefore, there are still disadvantages to be solved that the rotation drive mechanism is simplified and the rotation drive is performed with certainty.

Besides, the above-described disc music box does not have a satisfactory mechanism of positioning to start rotating the music box disc and of the stopping structure after one rotation of the music box disc.

SUMMARY OF THE INVENTION

Accordingly, it is an object of the invention is to provide a disc music box which has a simplified rotation drive mechanism, assured rotation driving, and a mechanism of positioning to start rotating the music box disc and of securely stopping after one rotation of the music box disc.

According to one aspect of the invention there is provided a disc music box for playing a melody by rotating a music box disc having an engaging drive part formed of projections or holes for playing by a motor and plucking music box petals by star wheels guided and turned by the engaging drive part, characterized in that the music box disc is driven to rotate by a turn plate on which the center of the music box disc is placed, and a transmission mechanism is disposed between the turn plate and the motor to transmit the drive force of the motor to the turn plate.

Therefore, the music box disc has its center pushed to rotate, and it is rotated smoothly. As a result, since an area apart from the center of the music box disc rotates accurately, rotation information taken from the rim of the music box disc becomes accurate, and this rotation information can be used to drive another actuator.

According to another aspect of the invention there is provided a music box wherein a safety switch mechanism is disposed to instruct to stop the play of the music box if the music box disc is not mounted.

Therefore, the operation in error can be prevented if the music box disc is not mounted, and even while the music box is playing, if the mounting of the music box disc is released because of some reason, the operation of the music box can be stopped from playing, any damage or personal injury can be prevented from occurring, and safety can be improved.

According to still another aspect of the invention there is provided a disc music box wherein an engaging part such as a notch is formed on the turn plate, and a switch is disposed to engage with the engaging part when the turn plate is rotated one time.

Therefore, a detection signal of the termination of one rotation is outputted from this switch, the rotational drive of the music box disc can be stopped based on the detection signal, and an automatic stop mechanism can be achieved.

According to yet another aspect of the invention there is provided a disc music box wherein a part of the engaging drive part for playing the music box disc is used for the engaging part for detecting one rotation, and a switch is disposed to engage with the engaging part when the music box disc makes one rotation.

Therefore, the automatic stop mechanism can be achieved in the same way as described above. In this case, since a part of the engaging drive part for playing the music box disc is used for the engaging part for detecting one rotation, another engaging part is not required for detecting one rotation, and laborsaving can be made.

According to another aspect of the invention there is a disc music box wherein an engaging part for detecting one rotation is formed independent of the engaging drive part for playing of the music box disc, and a switch is disposed to engage with the engaging part when the music box disc makes one rotation.

Therefore, the automatic stop mechanism can be achieved in the same way as described above. In this case, since the engaging part for detecting one rotation is formed independent of the engaging drive part for playing of the music box disc, the engaging part for detecting one rotation can be formed at a desired position as required, and flexibility of designing can be improved.

According to still another aspect of the invention there is provided a disc music box wherein a positioning hole for positioning of the turn plate by a positioning pin to assemble the turn plate is formed on the turn plate and a member on the side of fixing the disc music box.

The turn plate is generally provided with a positioning part for mounting the music box disc, and the turn plate and the music box disc are mounted accurately. And, it was conventionally often that the music box disc was mounted with deviation because of the deviated initial assembling of the turn plate, but by forming the positioning hole on the turn plate and disc music box fixing-side member, deviated mounting of the music box disc can be remedied.

BRIEF DESCRIPTION OF THE DRAWINGS

FIG. 4(2) is a perspective view showing a state that the incision is pushed and erected;

FIG. 4(3) is a perspective view showing a state that the erected part is folded at the middle as projection;

FIG. 6(2) shows an initial state that a pick of the star wheel is engaged with a playing hole of the music box disc;

FIG. 6(3) shows a state that a music box petal is plucked by a pick of the star wheel to produce a sound; and FIG. 6(4) shows a state restored to be ready to produce a sound.

DESCRIPTION OF THE PREFERRED EMBODIMENT

Figure 1:
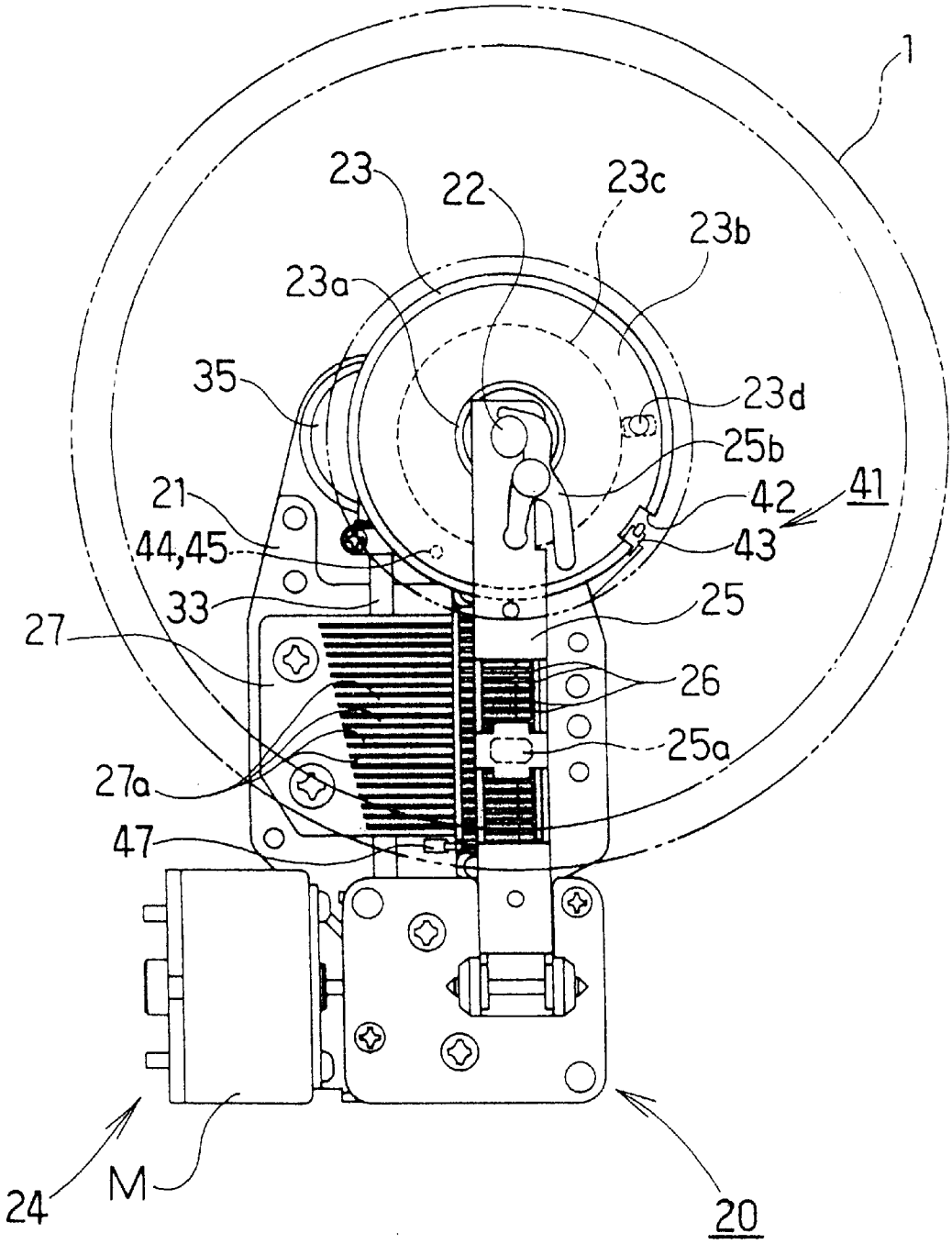
FIG. 1 is a front view showing the entire structure of an embodiment of the disc music box of the invention.
Figure 2:
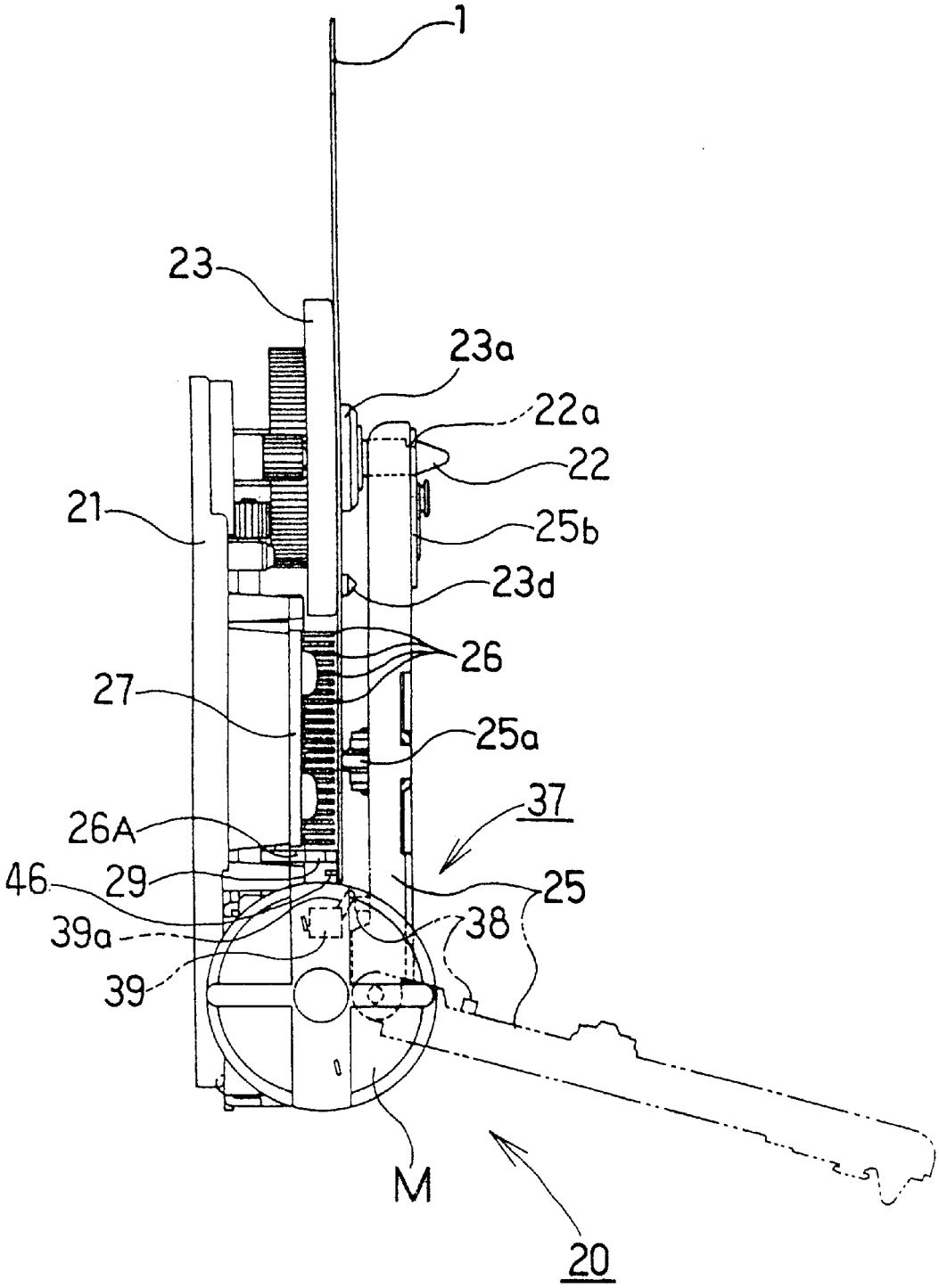
FIG. 2 is a side view showing the schematic entire structure of an embodiment of the disc music box of the invention.

As shown in FIG. 1 and FIG. 2, a disc music box 20 in this embodiment uses a music box disc 1 which can be changed easily and quickly to play the music box. For convenience of description, the music box disc 1 will be described first in detail.

Figure 3:
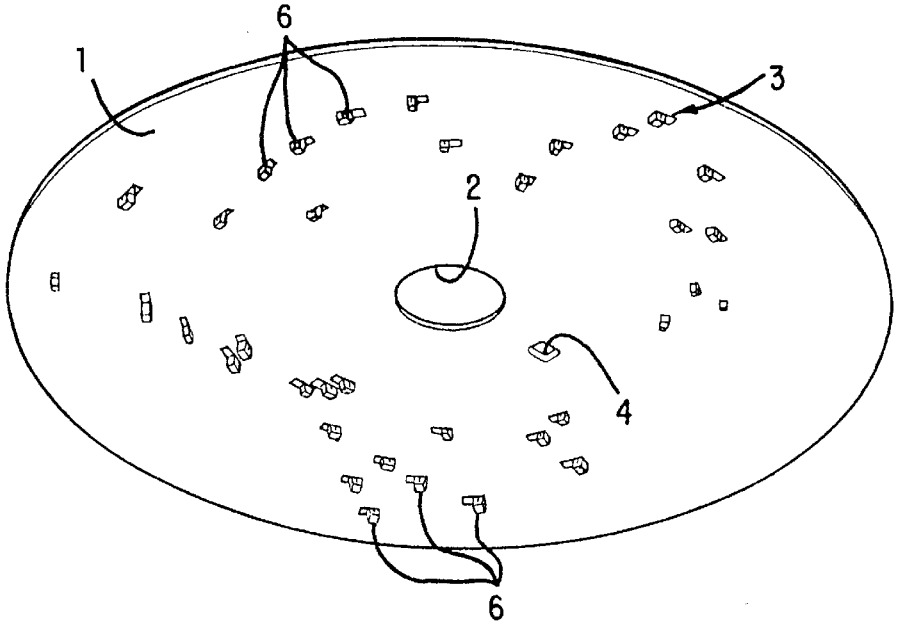
FIG. 3 is a perspective view showing the schematic entire structure of a music box disc.

The music box disc 1 used for the disc music box of this embodiment is made of light metal such as an aluminum material formed into a circular plate having a predetermined rigid strength, and has on its back a plurality of playing engaging parts 3 corresponding to the pattern of a music number. As shown in FIG. 3, at the center of the music box disc 1, a circular fitting hole 2 having a predetermined diameter is formed, and a drive hole 4 which is used to control the rotation of the music box disc is formed in the neighborhood of the fitting hole 2 at an angled position corresponding to a playing pattern. The control of rotating the music box disc using the drive hole 4 will be described afterwards.

And, the back face of the music box disc 1 is divided into a plurality of tracks in a radial direction corresponding to music box petals 27*a* of a music box sounding member 27 of the music box 20 to be described afterward, and the playing engaging parts 3 are formed at positions in the circumferential direction corresponding to the timing of playing musical scales shared by the respective tracks. And, a predetermined playing pattern is formed by these engaging parts for playing.

Figure 4:
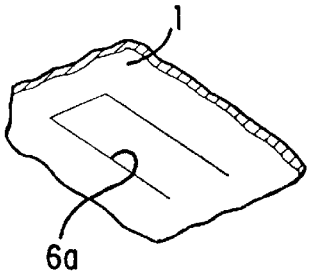
FIG. 4(1) is a perspective view showing a state that an incision is made on the music box disc.
Figure 4:
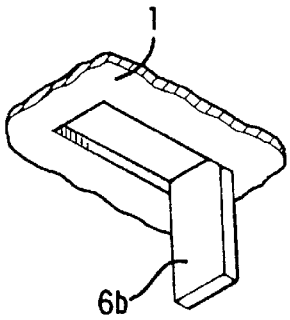
Figure 4:
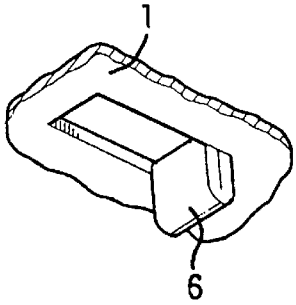

And, the playing engaging parts 3 in this embodiment are of a projection type, and the music box disc 1 made of metal has incised and erected parts at appropriate positions to form projections 6. These projections 6 are used as the engaging and driving parts 3 for sounding operation. Specifically, a substantially rectangular U-shaped incision 6*a* is formed (FIG. 4(1)), this incision 6*a* is pushed and erected as an erected part 6*b* (FIG. 4(2)), and the erected part 6*b* is folded at its middle to form the projection 6 which protrudes to a predetermined height from the back face of the music box disc 1 (FIG. 4(3)). And, the playing engaging parts 3 are formed sequentially from the inner to outer peripheries of the music box disc 1 by an automatic finishing machine. Since the playing engaging parts 3 are formed as described above, a large number of music box discs 1 can be produced by means of simple production jigs and production process.

The disc music box 20 using the music box disc 1 as described above comprises a base 21 which is formed in a substantially flat plate shape having a predetermined plane shape, a turn plate 23 which is rotatably fitted with play to a center shaft 22 which is set up on the base 21, a holding arm 25 which detachably holds the music box disc 1 on the turn plate 23, a drive mechanism 24 which drives to rotate the turn plate 23, a music box sounding member 27 which is driven to sound by the respective playing engaging parts 3 of the music box disc 1 to be driven to rotate together with the turn plate 23 through the star wheel 26.

The base 21 is made of a material having a high rigid strength to be longer than at least a radius of the music box disc 1, has at its one end in the longitudinal direction the turn plate 23 to hold and rotatably support the music box disc 1 by a shaft and at the other end a motor M for the drive mechanism 24, and among them are disposed a transmission shaft and gears of the drive mechanism 24 to decelerate and transmit the motor's rotating drive force to the turn plate 23 while playing the music box. And, thread holes are formed at predetermined positions of the base 21 to mount the disc music box 20 to a timepiece or the like.

This turn plate 23 is fitted with play to the center shaft 22 made of metal disposed on the base 21, and an E ring is fitted on the side of the leading end of the turn plate 23 to prevent it from coming out.

And, the turn plate 23 is made of a synthetic resin in the form of a thick circular plate, a fitting part 23*a* having an outer diameter corresponding to the inner diameter of the music box disc 1 is disposed on the side of its leading end, a supporting part 23*b* having a diameter larger than the fitting part 23*a* and supporting the lower surface of the music box disc 1 is formed at its middle, and a gear part 23*c* engaged with an output gear of the drive mechanism is disposed on the side of the base end. And, a drive projection 23*d* is projected on the turn plate 23 at the position corresponding to the drive hole 4 of the music box disc 101. In the drawing, 29 is a supporting member which supports the lower face on the outer periphery of the music box disc 1 to stabilize the music box disc 1.

Besides, the turn plate 23 is connected to the drive mechanism 24 which drives to rotate the turn plate 23 in a predetermined rotating direction at a predetermined speed when the music box is playing.

Figure 5:
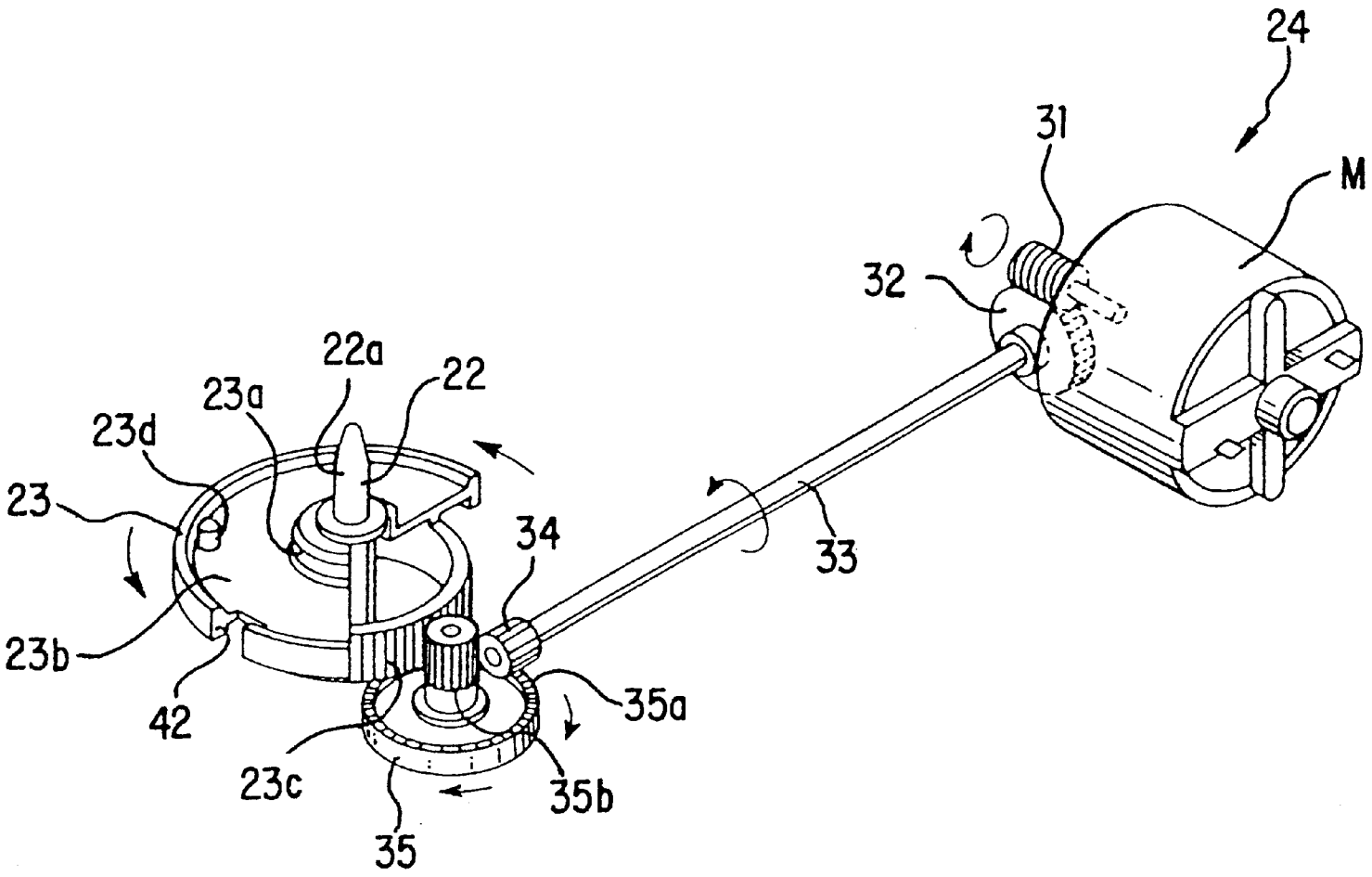
FIG. 5 is a perspective view showing a drive mechanism with partial omission for the music box disc in the same embodiment.

As shown in FIG. 5, the drive mechanism 24 comprises the motor M which is disposed so as to be located outside the music box disc 1 when the music box disc 1 is fitted to the turn plate 23, and the first input gear 32, the transmission shaft 33, the first output gear 34 and the second gear 35 which decelerate and transmit the rotational output of the motor to the turn plate 23.

The motor M is a DC motor and fixed to the base 21 to locate outside the music box disc 1 with the motor shaft in parallel to the plane of the base 21 and orthogonal to the longitudinal direction of the holding arm 15. Therefore, the motor M can be held stably on the plane of the base 21, and the thickness of the disc music box 20 can be made substantially minimum, namely a height corresponding to about the motor diameter, so that the disc music box 20 can be made thin.

And, a connection terminal of the motor M is connected to a motor drive circuit (not shown), and the motor M is driven by a drive current supplied from the motor drive circuit. And, the motor M is configured not to operate when the holding arm 25 is not locked by a safety switch mechanism 37 as will be described afterward.

A worm gear 31 is fixed to the output shaft of the motor M, and the first input gear 32 is engaged with the worm gear 31. The first input gear 32 is fixed to one end of the transmission shaft 33 which is orthogonal to the longitudinal direction of the motor's output shaft and supported in parallel to a star wheel shaft 26A. And, the first output gear 34 is fixed to the other end of the transmission shaft 33. The first output gear 34 is engaged with an input gear 35*a* of the second gear 35, and an output gear 35*b* which is integrally formed with the second gear 35 is engaged with the gear 23*c* which is integrally formed with the base end of the turn plate 23.

The second gear 35 is provided with the input gear 35*a* and the output gear 35*b* which are orthogonal to it and formed integrally. The input gear 35*a* has a substantially circular outer periphery rim protruded in the axial direction and gear teeth formed on the protruded end face so as to engage with the first output gear 34. And, the output gear 35*b* of the second gear 35 is an external tooth having a predetermined diameter coaxial with the input gear 35*a* and on its inner periphery, and engaged with the gear 23*c* which is integrally formed at the base end of the turn plate 23. Therefore, the rotations of the first input/output gears are reduced and transmitted to the turn plate 23 which is disposed on the base 21 in a direction orthogonal to the rotation shaft of the output gear 34.

Besides, a predetermined deceleration ratio is determined between these gears 31, 32, 34, 35*b*, 23*c* engaged one another.

Therefore, the rotating drive force of the motor M is transmitted to the turn plate 23 while being decelerated to a predetermined speed by the drive mechanism 24, and the music box disc 1 fitted to the turn plate 23 is rotated at a predetermined rotational speed.

And, as shown in FIG. 1 and FIG. 2, the holding arm 25 is formed in a substantially long plate which is longer than at least the radius of the music box disc 1, with its base end supported on the base 21 with a shaft and its leading end formed to be engageable and lockable to the center shaft 22 erected from the base 21, and provided with a roller 25*a* which pushes while rotating the music box disc 1 against the star wheels 26 on the side of the base 21.

Specifically, a notch 22*a* is formed on the tip of the center shaft 22 where the holding arm 25 is engaged, a lock arm 25*b* having a predetermined shape is disposed on the pertinent part of the holding arm 25 according to the notch 22*a*, and the lock arm 25*b* is pushed by a spring to have its end engaged with the notch 22*a*.

Therefore, unless the engagement of the lock arm 25*b* is released by the user, the music box disc 1 is fitted to the music box 20 and securely held. The music box disc 1 is stably held regardless of the position of the music box 20 itself to enable the music box play. On the other hand, releasing the holding arm 25 for its lock and tilting it to erect, the music box disc 1 can be changed quickly and easily.

Besides, this embodiment has a safety switch mechanism 37 to check that the holding arm 25 is locked or not.

Specifically, as shown in FIG. 2, the safety switch mechanism 37 comprises a projection 38 disposed on the holding arm 25 at a position outside of the music box disc 1 of the holding arm 25 to oppose in the direction of the music box disc 1, and a microswitch 39 having a rising/falling switch lever 39*a* disposed on the base 21 at a predetermined position to correspond to the projection 38. This microswitch 39 is electrically connected directly to a signal wire for transmitting a start signal to start the music box.

The microswitch 39 is fixed to the base 21 to correspond to the projection 38, and has on its top the general rising/ falling switch lever 39*a* and on its base an electrical switch contact terminal.

Namely, the switch lever 39*a* is pushed to stand upward by a spring or the like, and when it is stood, the switch is electrically turned off, and when the switch lever 39*a* is fallen, the switch is turned on.

Therefore, when the holding arm 25 is opened, the projection 38 formed on the holding arm 25 is separated from the microswitch 39, the switch lever 39*a* of the microswitch 39 is stood to turn off the switch, and the music box 20 is prevented from operating. On the other hand, when the holding arm 25 is locked, the projection 38 of the holding arm 25 becomes close to the microswitch 39, the switch lever 39*a* is fallen to turn on the switch 39, and the music box 20 becomes operable.

In addition, it can be configured so that the set condition of the music box disc 1 can be determined at the same time. Specifically, the microswitch 39 which has the switch lever 39*a* protruded by a predetermined level toward the music box disc 1 may be disposed in the same way at a position of the holding arm 25 opposed to the music box disc 1, and the microswitch 39 is connected to the control circuit. Therefore, when the holding arm 25 is opened, the switch lever 39*a* of the microswitch 39 stands to prevent the music box from operating, and even when the holding arm 25 is locked without fitting the music box disc, the switch lever 39*a* becomes in an erected state, and the music box 20 is prevented from operating.

Accordingly, by virtue of the safety switch mechanism 37, a malfunction with the music box disc not fitted can be prevented, and even when the lock of the holding arm 25 is released while the music box is playing by accident or by the user as required, the operation of the music box can be stopped, any damage or personal injury can be prevented, and safety can be improved.

Specifically, in FIG. 1 and FIG. 2, the music box sounding member 27 for the sounding operation of the music box is formed of a metal material to have a long plate shape and disposed on the base 21 in parallel to the music box disc 1. The leading end at one end of the music box sounding member 27 has the music box petals 27*a* formed in the form of comb teeth, and the base end on the side of the other end is fixed to a seat disposed on the base 21 so that the end on the side of the music box petals 27*a* is aligned in the radial direction of the music box disc 1 corresponding to the holding arm 25. And, these music box petals 27*a*, 27*a* are disposed in a predetermined number corresponding to the number of musical scales to be sounded, and formed to have predetermined thickness and length corresponding to the musical scales. When the tips of the music box petals 27*a*, 27*a* are plucked, music box sounds are produced at predetermined musical scales/musical intervals.

And, the plurality of star wheels 26 corresponding to the number of musical scale tracks of the music box disc 1 are rotatably supported by the star wheel shaft 26A at the position on the side of the lower surface of the music box disc 1 with respect to the holding arm 25.

The star wheels 26 have eight picks so that they can be engaged with the engaging projections of the music box disc 1 regardless of their rotating positions. These picks 26*a* are formed to have an acute sloped surface on their front sides in the rotating direction but to have on their back sides a surface orthogonal to the rotating direction, so that the engagement with the engaging projections of the music box disc 1 can be made with reliability.

As compared with the perforated type, as the playing engaging parts, it is not necessary to operate for arranging the picks of all the star wheels in a row or to push the star wheels in the rotating direction to engage the picks with the holes with reliability, and the structure can be made simple.

And, a synthetic resin useful to reduce friction is used to dispose a separating member having a gap of a predetermined width in the number same to the star wheels 26 at the base 21 opposed to the respective star wheels 26 to keep a predetermined interval along the longitudinal direction of the star wheel shaft of the respective star wheels 26. Therefore, the respective star wheels 26 can keep the position always rotatable and opposed to the music box petals 27*a* of the corresponding music box sounding member 27.

And, after the music box disc 1 selected as desired is fitted to the base 21, an activation signal is output from a control circuit (not shown) on the hour or the like or a monitor switch (not shown) is turned on by the user, the music box disc 1 is driven to rotate by the drive mechanism 24, and the music box petals 27*a* corresponding to the musical scales of a music number are plucked by the picks 26*a* of the star wheels 26 with predetermined timing to play the music box.

Specifically, the projections of the respective engaging parts 3 for playing of the music box disc 1 catch the picks 26*a* of the star wheels 26 corresponding to the playing engaging parts 3 to force the star wheels 26 rotate, and the music box petals 27*a* are finally plucked by the subsequent other picks 26*a* of the rotating star wheels 26 to produce the music box sounds.

Figure 6:
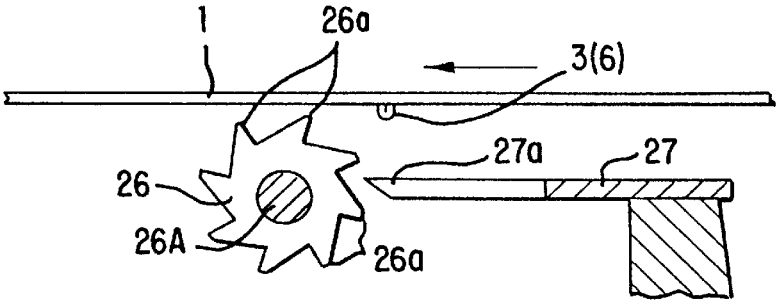
FIG. 6(1) shows a state ready to produce a sound.
Figure 6:
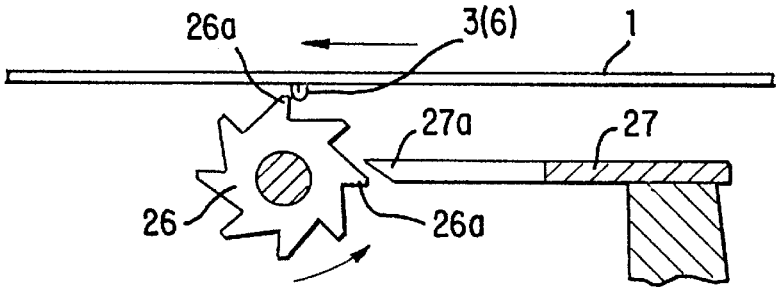
Figure 6:
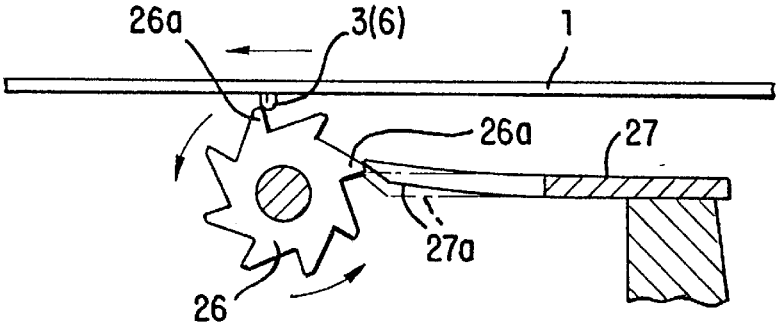
Figure 6:
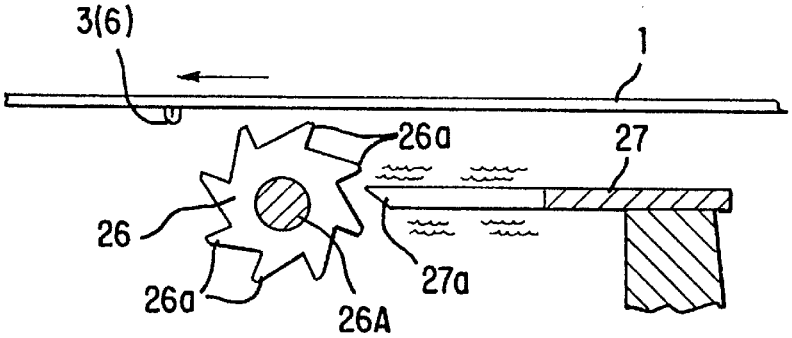

As shown in FIG. 6, the music box disc 1 is driven to rotate (FIG. 6(1)), the playing engaging part 3 is engaged with, for example, the pick 26*a*, among the picks 26*a* of the star wheel 26 (FIG. 6(2)), the pick 26*a* is forced to move by the projection 6 of the engaging part 3, and the star wheel 26 is rotated. At the same time, the pick 26*a* subsequent to the pick 26*a* of the star wheel 26 comes in contact with the music box petal 27*a* (FIG. 6(3)) and further moves to pluck the music box petal 27*a* (FIG. 6(4)). As a result, the music box sound particular to the music box petal 27*a* is produced.

Besides, this embodiment has an auto-stop mechanism 41 disposed to automatically stop the play of the music box after one rotation of the music box disc 1, thereby enabling to apply to a trick timepiece or the like This auto-stop mechanism 41 comprises a detecting notch 42 formed on the turn plate 23 and a microswitch 43 for detecting disposed at a predetermined position on the base 21.

And, to enable the auto-stop mechanism 41, positioning holes 44, 45 for positioning and incorporating the rotation position of the turn plate 23 at a position to detect one rotation by the microswitch 43 are disposed on the base 21 and the turn plate 23.

Specifically, since the drive hole 4 of the music box disc 1 is engaged with the drive projection 23*b* disposed on the turn plate 23 to fit the music box disc 1 to the turn plate 23, the music box disc 1 is fitted at a constant turning angle to the turn plate 23. Therefore, the play starting position of the music box disc 1 fitted to the turn plate 23 is kept constant with respect to the base 21, and the music box cannot start to play or complete even when the relational position between them is slightly deviated.

Specifically, when the turn plate 23 is driven to rotate and the notch 42 of the turn plate 23 reaches the position where it is detected by the microswitch 43, the rotational position of the music box disc 1 the rotation of which is restricted by the drive projection 23*b* of the turn plate 23 is always required to be at the play termination position (hereinafter called the rotation standard position).

Specifically, as shown in FIG. 1 and FIG. 2, since the auto-stop mechanism 41 comprises the notch 42 formed to a predetermined length in the circumferential direction on the outer periphery of the supporting part 23*b* of the turn plate 23 and the microswitch 43 disposed at a predetermined position on the base 21 which is a disc music box fixing side member, the turn plate 23 is assembled with a pin engaged with the positioning holes 44, 45 formed on the base 21 and the turn plate 23, so that the turn plate 23 can be disposed at a proper rotation standard position.

When the position where the microswitch 43 is disposed and the position where the notch 42 is formed are vertically matched mutually with the position of the drive projection 23*b* on the turn plate 23 as the reference, the rotation position of the music box disc 1 by the drive projection 23*b* is determined to be a start or completion position of playing.

And, a distance between the microswitch 43 and the lower surface of the supporting part 23*b* of the turn plate 23 is set to be shorter than the overall length of its switch lever 43*a*, namely a distance that the switch lever 43*a* is contacted to and tilted by the lower surface of the supporting member 23*b* at the rotation position during the music box's play. Besides, the microswitch 43 makes a reverse operation that it outputs an off signal when the switch lever 43*a* falls, and outputs an off signal when the switch lever 43*a* stands. In addition, the microswitch 43 in the ordinary setting may be used through a reverse circuit.

Besides, the notch 42 formed on the supporting member 23*b* of the turn plate 23 is formed to have a predetermined length in the circumferential direction to detect with reliability at a position on the outer periphery of the supporting part 23*b* and satisfying the above-described conditions.

Therefore, while the music box is playing, the turn plate 23, namely the music box disc 1, is driven to rotate and reached the standard rotation position to terminate playing after one rotation, the notch 42 formed on the supporting part 23*b* of the turn plate 23 is positioned just above the microswitch 43, the switch lever 43 stands up, and an on-state detection signal is output from the microswitch 43. According to this detection signal, the music box disc 1 can be stopped rotating by the control circuit. Thus, the auto-stop mechanism 41 can be achieved.

And, since the turn plate 23 is used to detect without forming a formed part such as a pick or hole for detecting one rotation on the music box disc 1 itself, the music box disc 1 can be produced easily in a large quantity, and it is possible to prevent a defect of rotation stop or the like in case that the formed part is damaged.

The positioning holes 44, 45 are not limited to a through hole but may be an appropriate hole such as a bag hole or a notch. It is to be understood that the engaging part used for positioning, such as a through hole, a bag hole, or a notch, is called the positioning hole in this specification.

And, once assembled, the turn plate 23 is engaged with the drive mechanism 24, so that the mutual relation, namely the rotational position, can be prevented from being deviated.

As described, the so-called center drive method is adopted as in this embodiment and the music box disc is securely started to play and stopped, and the music box disc can be revolved at a predetermined revolution speed. As a result, output information can be obtained accurately with the revolution of the music box disc. Therefore, instead of forming the detecting notch 42 on the turn plate 23, a pick for detecting one turn is formed at a predetermined position on the outer periphery of the music box disc 1 and a microswitch 46 is disposed on the base 21 (see FIG. 2), so that accuracy of control to stop the music box disc from revolving can be improved and other output information can be obtained. Specifically, at the outer periphery of the music box disc, a length in the peripheral direction is longer than at the inner periphery when the music box disc rotates, and the accuracy of detecting the rotation angle position can be improved. And, the position where the microswitch 43 is disposed on the base 21 and the position where the pick is formed on the music box disc 1 can have an enlarged allowance range, and a working machine for music box discs which forms the play engaging part at the inner periphery of the music box disc can be used therefor, so that the music box disc 1 can also be produced readily.

As shown in FIG. 1, a switch 47 which engages with the engaging projection 6 of the music box disc 1 may be disposed next to the music box petals 27*a* of the music box sounding member 27. In this case, turning on and off are made by the rotation of the star wheels 26, an engaging projection 6 for switching only may be formed separately. In this embodiment, assembling can be made with the same accuracy as the star wheels 26, and workability and assemblability are improved.

As described above, according to one aspect of the invention there is provided a disc music box for playing a melody by rotating a music box disc having an engaging drive part formed of projections or holes for playing by a motor and plucking music box petals by star wheels guided and turned by the engaging drive part, characterized in that the music box disc is driven to rotate by a turn plate on which the center of the music box disc is placed, and a transmission mechanism is disposed between the turn plate and the motor to transmit the drive force of the motor to the turn plate.

Therefore, the music box disc has its center pushed to rotate, and it is rotated smoothly. As a result, since an area apart from the center of the music box disc rotates accurately, rotation information taken from the rim of the music box disc becomes accurate, and this rotation information can be used to drive another actuator.

According to another aspect of the invention there is provided a disc music box wherein a safety switch mechanism is disposed to instruct to stop the play of the music box if the music box disc is not mounted.

Therefore, the operation in error can be prevented if the music box disc is not mounted, and even while the music box is playing, if the mounting of the music box disc is released because of some reason, the operation of the music box can be stopped from playing, any damage or personal injury can be prevented from occurring, and safety can be improved.

According to still another aspect of the invention there is provided a disc music box wherein an engaging part such as a notch is formed on the turn plate, and a switch is disposed to engage with the engaging part when the turn plate is rotated one time.

Therefore, a detection signal of the termination of one rotation is outputted from this switch, the rotational drive of the music box disc can be stopped based on the detection signal, and an automatic stop mechanism can be achieved.

According to yet another aspect of the invention there is provided a disc music box wherein a part of the engaging drive part for playing the music box disc is used for the engaging part for detecting one rotation, and a switch is disposed to engage with the engaging part when the music box disc makes one rotation.

Therefore, the automatic stop mechanism can be achieved in the same way as described above. In this case, since a part of the engaging drive part for playing the music box disc is used for the engaging part for detecting one rotation, another engaging part is not required for detecting one rotation, laborsaving can be made.

According to another aspect of the invention there is provided a disc music box wherein an engaging part for detecting one rotation is formed independent of the engaging drive part for playing of the music box disc, and a switch is disposed to engage with the engaging part when the music box disc makes one rotation.

Therefore, the auto-stop mechanism can be achieved in the same way as described above. In this case, since the engaging part for detecting one rotation is formed independent of the engaging drive part for playing of the music box disc, the engaging part for detecting one rotation can be formed at a desired position as required, and flexibility of designing can be improved.

According to still another aspect of the invention there is provided a disc music box wherein a positioning hole for positioning of the turn plate by a positioning pin to assemble the turn plate is formed on the turn plate and a member on the side of fixing the disc music box.

The turn plate is generally provided with a positioning part for mounting the music box disc, and the turn plate and the music box disc are mounted accurately. And, conventionally, the music box disc was sometimes mounted with deviation because of the deviated initial assembling of the turn plate, but by forming the positioning hole on the turn plate and disc music box fixing-side member, deviated mounting of the music box disc can be remedied.

Thus, the invention has advantages that the center drive method is adopted and the music box disc is securely started to play and stopped, and the music box disc can be revolved at a predetermined revolution speed. As a result, output information can be obtained accurately with the revolution of the music box disc.

What is claimed is:

1. A disc music box for playing a melody, comprising:

a base;

a music box disc having a plurality of engaging drive parts and a drive hole a plurality of music box petals provided on the base;

a plurality of star wheels each guided and revolved by one of the engaging drive parts, a turn plate provided coaxially with the music box disc and having a detecting member thereon;

a motor provided on the base;

a transmission mechanism disposed between the turn plate and the motor to transmit the drive force of the motor to the turn plate;

a drive projection provided on the turn plate for engagement with the drive hole of the music box disc for positioning the music box disc; and a switch provided on the base for engagement with the detecting member of the turn plate when the music box disc makes one rotation.

2. A disc music box, comprising:

a base;

a music box disc having a plurality of engaging drive parts and a drive hole;

a plurality of music box petals provided on the base;

a plurality of star wheels each guided and revolved by one of the engaging drive parts, a turn plate provided coaxially with the music box disc and having a detecting member thereon;

a motor provided on the base;

a transmission mechanism disposed between the turn plate and the motor to transmit the drive force of the motor to the turn plate; and safety switch means for stopping the play of the music box if the music box disc is not mounted.

3. The disc music box as set forth in claim 2, which further comprises:

a drive projection provided on the turn plate for engagement with the drive hole of the music box disc for positioning the music box disc.

4. The disc music box as set forth in claim 2 or 3, which further comprises a switch disposed on the base to engage with the the detecting member when the music box disc makes one rotation.

5. The disc music box as set forth in any one of claims 1 to 3, wherein the detecting member is a notch formed in a periphery of the turn plate.

6. The disc music box as set forth in claim 2 or 3, a member on the side of fixing the disc which further comprises a switch for engagement with one of the engaging drive parts when the music box disc makes one rotation.

7. A disc music box, comprising:

a base;

a music box disc having a plurality of engaging drive parts and a drive hole;

a plurality of music box petals provided on the base;

a plurality of star wheels each guided and revolved by one of the engaging drive parts, a turn plate provided coaxially with the music box disc;

a motor provided on the base;

a transmission mechanism disposed between the turn plate and the motor to transmit the drive force of the motor to the turn plate;

an engaging detection part provided on the music box disc for detecting one rotation, and a switch disposed to engage with the engaging detection part when the music box disc makes one rotation.

8. The disc music box as set forth in one of claims 1–3 and 7, which further comprises positioning holes provided on the turn plate and the base, respectively, to position the turn plate with respect to the base by means of a positioning pin when the turn plate is assembled.

9. The disc music box as set forth in one of claims 1–3 and 7, wherein the transmission mechanism comprises:

a first gear connected to the motor;

an input gear in mesh with the first gear;

a transmission shaft provided in parallel to the base and perpendicular to the axis of the motor and connected at one end to the first input gear;

an output gear connected to the other end of the transmission shaft; and a second gear in mesh with the output gear.

* * * * *